United States Patent [19]

Tropeano et al.

[11] Patent Number: 4,545,529

[45] Date of Patent: Oct. 8, 1985

[54] METHOD AND APPARATUS FOR AUTOMATICALLY MAKING SNOW

[76] Inventors: Joseph C. Tropeano; Joseph T. Tropeano; Thomas F. Tropeano, all of 12 Revere St., Lexington, Mass. 02173

[21] Appl. No.: 407,535

[22] Filed: Aug. 12, 1982

[51] Int. Cl.[4] ..... F25C 3/04

[52] U.S. Cl. ..... 239/2 S; 239/14; 239/75; 239/413; 239/416.2

[58] Field of Search ..... 239/2 S, 14, 75, 412, 239/413, 417.5, 570, 578, 416.2; 62/74; 236/102; 137/79

[56] References Cited

U.S. PATENT DOCUMENTS

| | | | |
|---|---|---|---|
| 1,881,637 | 10/1932 | Johnson | 236/102 |
| 2,564,896 | 8/1951 | Gustafsson et al. | 239/412 |
| 2,676,471 | 4/1954 | Pierce, Jr. | 239/2 S |
| 3,456,882 | 7/1969 | Walker | 239/412 |
| 3,513,906 | 5/1970 | Richards | 62/74 |
| 3,706,414 | 12/1972 | Dupre | 239/2 S |
| 3,761,020 | 9/1973 | Tropeano et al. | 239/2 S |

*Primary Examiner*—Andres Kashnikow
*Assistant Examiner*—Michael J. Forman
*Attorney, Agent, or Firm*—Bachman & LaPointe

[57] ABSTRACT

In a snow-making installation the pipelines for carrying the pressurized water and compressed air are provided over the entire length thereof with branch conduits for delivering the air and water under controlled conditions to a mixing chamber wherein the air and water are mixed and delivered to the nozzles of snow-making equipment which is permanently installed. The air branch conduit is provided with a selectively actuated valve which is automatically actuated from the control station located down the mountain. A valve positioned in the water branch conduit is activated upon sensing the flow of air in the air branch conduit thereby allowing water to pass to the mixing chamber where it is mixed with the air.

5 Claims, 7 Drawing Figures

METHOD AND APPARATUS FOR AUTOMATICALLY MAKING SNOW

BACKGROUND OF THE INVENTION

The present invention is drawn to a method and apparatus for making snow and more particularly a method and apparatus for making snow which is fully automatic.

In the snow-making art, it is well known to mix compressed air and pressurized water in a cold ambient atmosphere to produce a stream of snow particles. Typical snow-making apparatus comprise a plurality of snow-making nozzles which are fed compressed air and pressurized water through separate lines. The flow of compressed air and pressurized water to the nozzles of the snow-making apparatus are provided by conventional air compressors and water pump equipment. The compressors and pump equipment are generally located down the mountain far from the snow-making apparatus. The compressed air and pressurized water are fed to the snow-making apparatus via pipelines located beneath the surface of the earth. The pipelines are provided over the length thereof with branch conduits having coupling means for connecting hoses thereto. The hoses in turn are selectively connected by couplings to the snow-making apparatus for feeding compressed air and pressurized water to the snow-making nozzles. The branch conduits are provided with manually actuated stop valves for selectively controlling the flow of water and compressed air to the branch conduits and correspondingly the snow-making apparatus. A typical snow-making installation is disclosed in U.S. Pat. No. 2,676,471.

Heretofore, known snow-making installations as set forth above have suffered from a number of disadvantages. These disadvantages generally result from the fact that known systems require personal observation of climatic conditions on the slopes and the manual positioning and adjustment of the snow-making apparatus at optimum locations along the slopes. For example, in order to successfully produce snow it is necessary that the temperature be below freezing and preferably below 28° F. The temperature range on a mountain slope can vary significantly from trail to trail and thus require personal monitoring of the various locations. Once the suitable slopes and trails are located personnel must move the snow-making equipment including the snow guns and hoses to the appropriate locations on the slopes. The equipment must then be attached and the stop valves for feeding air and water to the equipment must be set. The locations must then be continually monitored for climatic changes which would result in the formation of ice, water, etc. As can be seen from the foregoing, installations heretofore known require numerous personnel to effectively monitor the slopes and operate the snow-making equipment all of which greatly adds to the operating costs of ski area operators.

Accordingly, it is a principle object of the present invention to provide a method and apparatus for effectively making snow which is substantially fully automatic.

It is a particular object of the present invention to provide a method and apparatus for effectively making snow wherein the flow of compressed air and water to the snow-making apparatus is automatically controlled.

Further objects and advantages of the present invention will appear hereinbelow.

SUMMARY OF THE INVENTION

In accordance with the present invention, the foregoing objects and advantages are readily obtained.

The present invention resides in a method and apparatus for making snow and more particularly a method and apparatus for making snow which is substantially fully automatic. In accordance with the present invention the pipelines for carrying the pressurized water and compressed air are provided over the entire length thereof with branch conduits for delivering the air and water under controlled conditions to a mixing chamber wherein the air and water are mixed and delivered to the nozzles of the snow-making equipment which is permanently installed at various locations along the pipeline. Provided in the air branch conduit downstream of the air pipeline and upstream of the mixing chamber is a solenoid actuated valve which is automatically actuated from a control station located down the mountain upon the sensing of a pre-determined sensed climatic condition. The actuation of the valve in the air branch conduit permits air to pass through the conduit to the mixing chamber. A pneumatically actuated valve positioned in the water branch conduit downstream of the water pipeline and upstream of the mixing chamber is in communication with the air branch conduit downstream of the valve therein and is moved to its open position when air is passed to the mixing chamber thereby allowing water to pass through the valve to the mixing chamber. Provided downstream of the pneumatically actuated valve in the water conduit and upstream of the mixing chamber is a temperature sensitive flow control valve for controlling the flow of water to the mixing chamber.

In accordance with the present invention, the temperature is sensed at various points along the slopes and trails and upon sensing a pre-determined temperature, for example 28° F., a signal is sent to the control station down the mountain. The operator in the control station activates the pumps and compressors and the solenoid valves in the air branch conduits located on the slope where the temperature signal was generated. The pneumatic valves in the corresponding water pipes are then actuated and water and air are fed to the mixing chamber and snow-making equipment on the slope. By virtue of the method and apparatus of the present invention snow is delivered to the various slopes under ideal conditions thereby leading to efficient and optimum snow making. In addition, the fact that hoses are not used to deliver the air and water to the snow-making equipment eliminates the problem of line freeze up. Finally, the fact that the installation is substantially fully automatic lowers operating costs of the facility.

DETAILED DESCRIPTION

Figure 1:
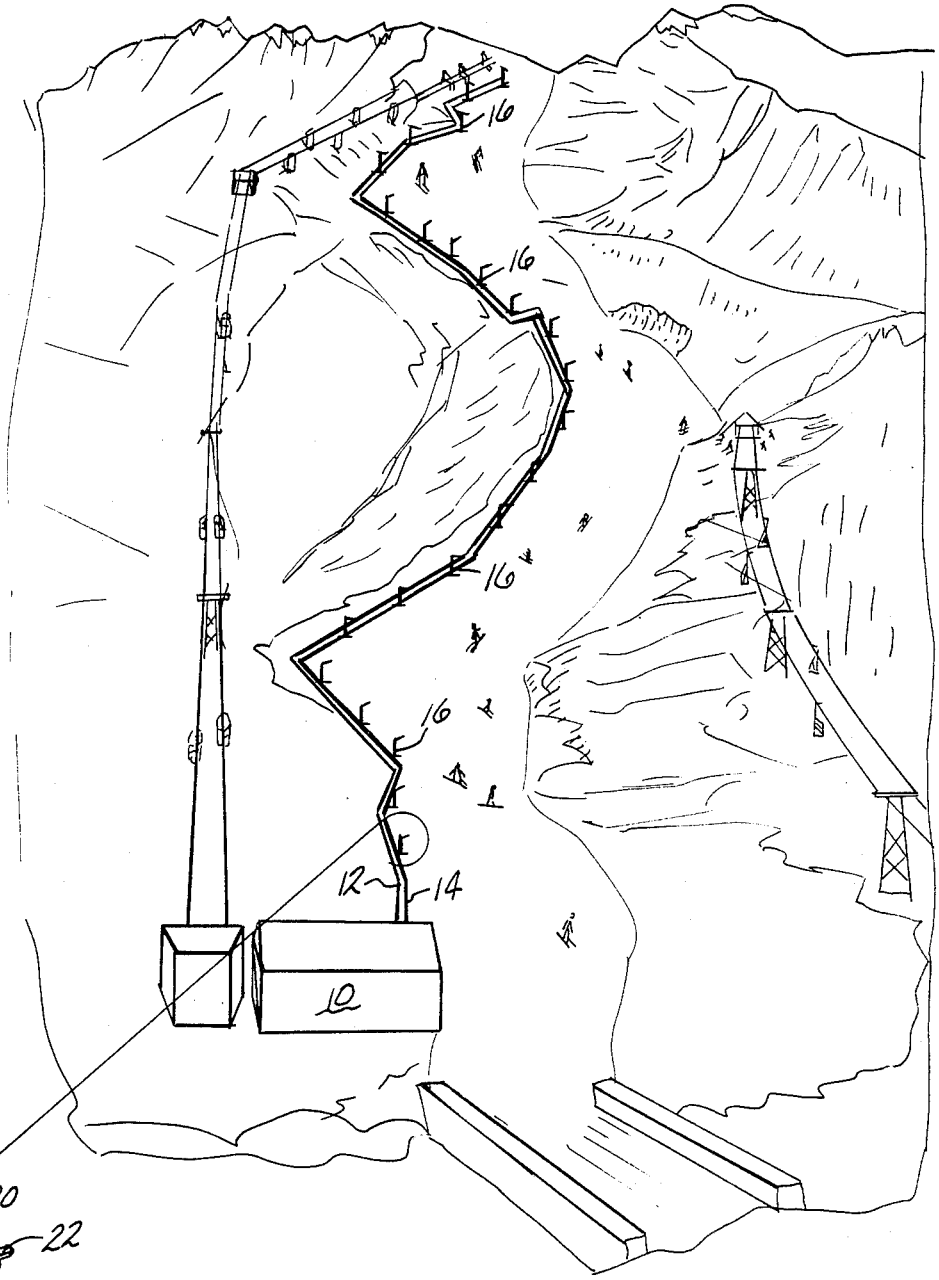
FIG. 1 is a perspective view illustrating an installation on a ski slope in accordance with the present invention.
Figure 2:
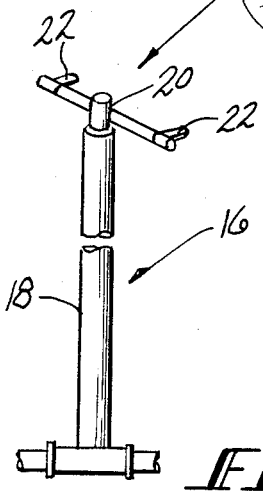
FIG. 2 is an enlarged view of the snow-making apparatus used in the installation of the present invention.

With reference to FIG. 1, an installation in accordance with the present invention is made along a ski trail. A control house 10 is located at the bottom of the mountain slope and is provided with compressors and pumps for delivering water and air via pipelines 12 and 14, respectively, along the entire length of the slope. The snow-making apparatus 16 is provided at various locations along the pipelines 12 and 14 over the entire length thereof for furnishing snow over the entire area of the trail. As can be seen in FIG. 2 the snow-making apparatus 16 comprises a mixing chamber 18 which receives air and water in a manner to be made clear hereinbelow. Positioned on top of the mixing chamber 18 of the snow-making apparatus 16 is a snow-making gun 20 having a plurality of nozzles 22.

Figure 3:
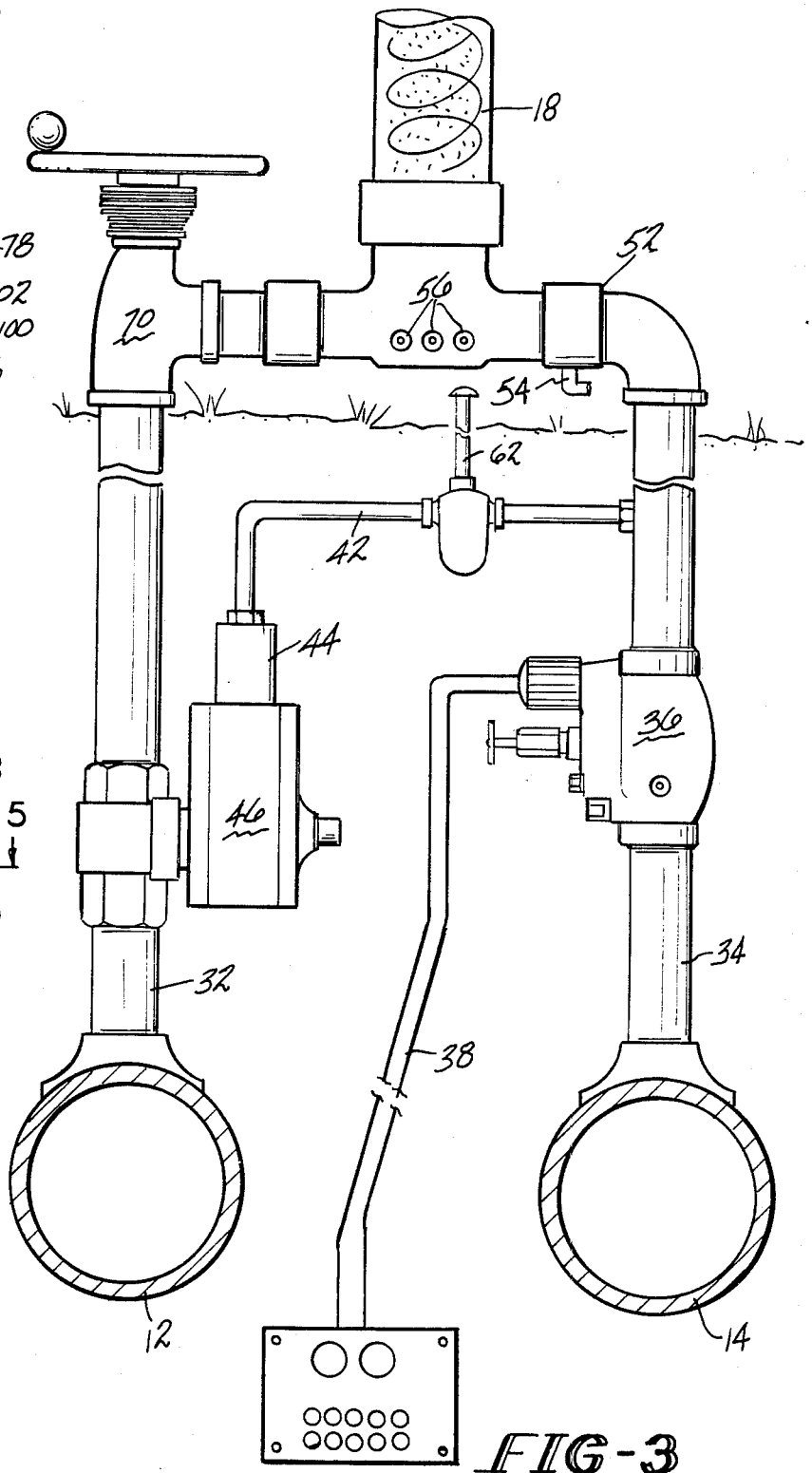
FIG. 3 is a partial sectional enlarged view of the installation of the present invention for delivering air and water to the snow-making apparatus illustrated in FIG. 2.

With reference to FIG. 3, the details of the snow-making installation will be discussed. The water and air pipelines 12 and 14 are located beneath the ground and are provided with branch conduits 32 and 34 for feeding water and air to the mixing chamber 18 of the snow-making apparatus 16. In accordance with the present invention branch conduit 34 is provided with a valve 36, preferably a solenoid actuated valve, which is selectively opened and closed so as to allow air to pass to the mixing chamber 18. The solenoid valve 36 is a conventionally known valve such as model 8024B manufactured by Weathermatic or the like. The valve 36 is operably connected to a control panel 40 located in control station 10 located down the mountain by means of electrical lines 38. The local climatic conditions are sensed by suitable known means and upon the sensing of a pre-determined temperature a signal is sent to the operator of the control panel 40 located in the control station 10. Located downstream of the valve 36 and upstream of the mixing chamber 18 is a branch conduit 42 which is in communication with the pneumatic actuator 44 of a pneumatic valve 46. The pneumatic valve 46 may be of any known type such as ball type valve model number 422 S.R. manufactured by Gemini Valve Inc.

Positioned within conduit 42 is an anti-freeze injector for injecting a mixture of anti-freeze and alcohol into conduit 42 for preventing freeze up of pneumatic actuator 44. Injector 60 comprises a feed stem 62 which protrudes out of the ground and is provided with a closure member 64. Feed stem 62 is in fluid communication with reservoir 66 which in turn communicates with conduit 42 via orifice 68 for feeding the anti-freeze mixture to the pneumatic actuator 44 as air passes through conduit 42 sucking in the anti-freeze mixture through orifice 68.

Figure 5:
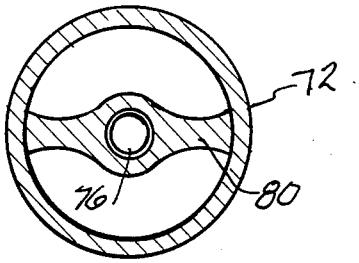
FIG. 5 is a sectional view through a portion of the flow control valve taken along line 5—5 of FIG. 4.
Figure 4:
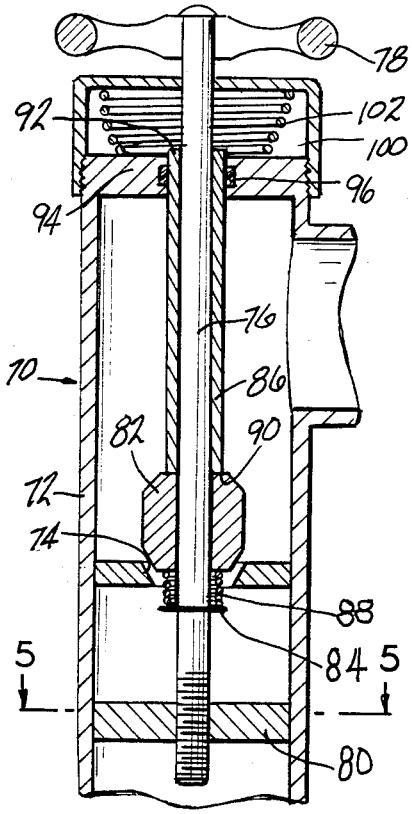
FIG. 4 is a detailed sectional view of the temperature sensitive flow control valve used in the installation of the present invention.
Figure 6:
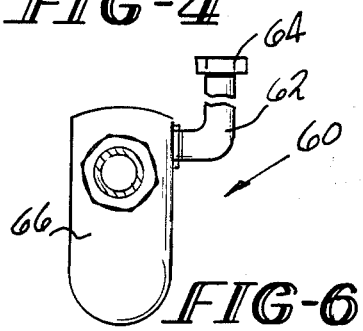
FIGS. 6 and 7 are detailed views of the anti-freeze injector used in the installation of the present invention.
Figure 7:
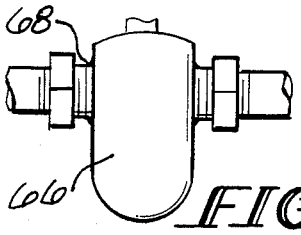

Downstream of the valve 46 and upstream of the mixing chamber 18 is a temperature sensitive flow control valve 70 for controlling the flow of water to the mixing chamber 18. As can best be seen in FIGS. 4 and 5, flow control valve 70 is provided with a valve housing 72 having a valve seat 74. A valve stem 76 having a handle 78 secured to one end thereof is threadably mounted in a web 80 which is secured within housing 72. Mounted on valve stem 76 for longitudinal movement along same is a valve body 82 which is adapted to seat on valve seat 74 in a manner to be made clear hereinbelow. Valve body 82 is mounted on valve stem 76 between a washer 84 fixed to stem 76 and a sleeve 86 which is movably mounted on stem 76. A spring 88 is located between washer 84 and valve body 82 for biasing the valve body 82 against one end 90 of sleeve 86. The other end 92 of sleeve 86 projects out of valve housing 72 into temperature sensing chamber 100. Sleeve 86 is sealed in end wall 94 by means of seal 96 so as to prohibit communication between valve housing 72 and sensing chamber 100. Mounted within chamber 100 for biasing sleeve 86 against valve body 82 is a temperature sensitive thermal spring 102. Upon sensing an increase in temperature, thermal spring 102 will expand thereby biasing sleeve 86 against valve body 82 and correspondingly spring 88 thereby restricting the flow of water to mixing chamber 18.

A spring-loaded one-way check valve 52 is provided in conduit 34 downstream of branch conduit 42 for preventing the back flow of water into conduit 34 upon the deactuation of solenoid valve 36. A drain 54 is provided immediately downstream of the check valve 52 for draining off any liquid which may accumulate in the installation when not in operation.

With reference to FIGS. 1–3, the operation of the installation of the present invention will be discussed in detail. Upon the sensing of a pre-determined temperature at any installation along the ski slope, a signal is generated and sent to the operator in the control station 10. The operator after receiving the signal activates the solenoid valves 36 at the appropriate location along the slope from which the signal was generated. Upon the opening of the solenoid valve 36 air is allowed to flow via conduit 34 through valve 36 and one-way check valve 52 into the mixing chamber 18 of the snow-making equipment 16. The flow of compressed air is also received in branch conduit 42 which directs air to pneumatic actuator 44. As air passes through conduit 42 the anti-freeze mixture in reservoir 66 of anti-freeze injector 60 is sucked through orifice 68 and carried along with the air pneumatic actuator 44 for opening pneumatic valve 46. Upon opening pneumatic valve 46 water is allowed to pass through the conduit 32, valve 46 and temperature sensitive flow control valve 70 into mixing chamber 18 wherein the air and water are mixed and delivered to the nozzles of the snow-making apparatus. The temperature sensitive flow control valve 70 senses the temperature change at the particular installation and adjusts the flow of water to the mixing chamber in accordance with any sensed temperature change in the following manner. Initially handle 78 is adjusted to provide the desired flow of water through the valve 70 for a particular temperature. During the operation of the installation as set forth above, water is fed through the valve 70 to mixing chamber 18. As the surrounding temperature decreases, thermal spring 102 contracts resulting in spring 88 biasing valve body 82 away from valve seat 74 thereby increasing the flow of water to mixing chamber 18. Thus, as the temperature decreases the temperature sensitive flow control valve opens so as to allow for a greater flow of water to the mixing chamber. Any increase in the surrounding temperature will result in the expansion of thermal spring 102 which correspondingly restricts the flow of water to chamber 18. If the temperature again rises above the minimum snow-making temperature a signal is once again sent to the operator in the control station. The operator then inactivates the circuit to solenoid valve 36 thereby cutting off the flow of air to the mixing chamber which correspondingly inactivates pneumatic valve 46 thereby cutting off the flow of water to the mixing chamber. Any water left in the chamber 18 and conduit 32 upstream of the valve 46 is drained from the pipes via drains 54 and 56 thereby prohibiting any freeze up in the lines.

As can be seen from the foregoing, in accordance with the present invention, effective snow making is accomplished in a simple and economical manner without the need of numerous personnel to effectively monitor the slopes and operate the snow-making equipment. By way of the present invention the flow of compressed air and water to the snow-making apparatus is automatically controlled and only operated upon the sensing of a pre-determined climatic condition which is suitable for snow making.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. In an installation for making snow wherein a stream of compressed air and a stream of pressurized water are fed to the nozzles of snow-making equipment, a method for automatically controlling the flow of air and water to the snow-making equipment comprising the steps of:

providing at least one snow-making installation, a source of compressed air and a source of pressurized water;

sensing a predetermined ambient condition at said at least one snow-making installation;

feeding compressed air to said at least one snow-making installation in response to said sensed predetermined ambient condition;

automatically sensing the flow of compressed air to said at least one snow-making installation; feeding pressurized water to said at least one snow-making installation in response to said sensed compressed air flow; and providing a temperature-sensitive flow control valve between said source of pressurized water and at least one snow-making installation for controlling the flow of water to said at least one snow-making installation in response to minor temperature changes such that the flow of water to said at least one snow-making installation increases upon a decrease in temperature and decreases upon an increase in temperature.

2. In an installation for making snow wherein a stream of compressed air and a stream of pressurized water are fed to the nozzles of snow-making equipment, an apparatus for automatically controlling the flow of air and water to the snow-making equipment comprising:

a source of compressed air and a source of pressurized water;

an air and water mixing chamber;

a first conduit for feeding compressed air from said compressed air source to said mixing chamber;

a second conduit for feeding pressurized water from said pressurized water source to said mixing chamber;

first valve means in said first conduit for controlling the flow of compressed air to said mixing chamber;

second valve means in said second conduit for controlling the flow of pressurized water to said mixing chamber;

sensing means downstream of said first valve means for sensing flow of compressed air through said first conduit and opening said second valve means in response to said sensed compressed air flow; and temperature-sensitive flow control means downstream of said second valve means for controlling the flow of water to said at least one snow-making installation in response to minor temperature changes such that the flow of water to said at least one snow-making installation increases upon a decrease in temperature and decreases upon an increase in temperature.

3. An apparatus according to claim 2 wherein said second valve means is a pneumatically actuated valve.

4. An apparatus according to claim 3 wherein said sensing means comprises third conduit means for communicating compressed air from said first conduit to the actuator of said second valve means.

5. An apparatus according to claim 4 wherein injector means is located in said third conduit means for injecting an anti-freeze mixture into said third conduit.

* * * * *